US011140937B2

(12) United States Patent
Carter et al.

(10) Patent No.: US 11,140,937 B2
(45) Date of Patent: Oct. 12, 2021

(54) APPARATUS FOR THE APPLICATION OF MATERIAL TO A CREASE OF A GARMENT

(71) Applicant: Supercrease Limited, Leeds (GB)

(72) Inventors: Shaun Carter, Leeds (GB); Kenneth Houlbrook, Leeds (GB)

(73) Assignee: Supercrease Limited, Leeds (GB)

( * ) Notice: Subject to any disclaimer, the term of this patent is extended or adjusted under 35 U.S.C. 154(b) by 0 days.

(21) Appl. No.: 16/340,200

(22) PCT Filed: May 31, 2018

(86) PCT No.: PCT/GB2018/051482
§ 371 (c)(1),
(2) Date: Apr. 8, 2019

(87) PCT Pub. No.: WO2018/220377
PCT Pub. Date: Dec. 6, 2018

(65) Prior Publication Data

US 2020/0077729 A1 Mar. 12, 2020

(30) Foreign Application Priority Data

May 31, 2017 (GB) ..... 1708640

(51) Int. Cl.

| | |
|---|---|
| ***A41H 43/04*** | (2006.01) |
| ***A41D 1/10*** | (2006.01) |
| ***A41D 27/24*** | (2006.01) |
| ***B05C 9/06*** | (2006.01) |

(Continued)

(52) U.S. Cl.
CPC ..... *A41H 43/04* (2013.01); *A41D 1/10* (2013.01); *A41D 27/245* (2013.01); *B05C 9/06* (2013.01); *B05C 17/00596* (2013.01); *B05C 17/015* (2013.01); *A41D 2300/52* (2013.01)

(58) Field of Classification Search
CPC ..... A41H 43/00; A41H 43/04; A41D 1/10; A41D 27/245; A41D 2300/52; B05C 9/06; B05C 17/00596; B05C 17/015
See application file for complete search history.

(56) References Cited

U.S. PATENT DOCUMENTS 4,721,234 A * 1/1988 Spence ..... B05C 17/005 118/410
5,035,199 A * 7/1991 Hageman ..... A41D 1/10 118/681

(Continued)

FOREIGN PATENT DOCUMENTS

| | | |
|---|---|---|
| EP | 1185379 B1 | 4/2004 |
| EP | 1405678 A2 | 4/2004 |
| EP | 1439009 A1 | 7/2004 |

OTHER PUBLICATIONS

Machine translation of EP 1439009 (Year: 2020).*

*Primary Examiner* — George R Koch
(74) *Attorney, Agent, or Firm* — Gable Gotwals

(57) ABSTRACT

An apparatus for the application of resin material along crease line of one or more garments simultaneously by providing means which allow at least first and second cartridges containing the resin material to be mounted in a spaced relationship so as to allow resin from each of the cartridges to be dispensed simultaneously. The resin can be applied in substantially less time than conventional systems which only use one cartridge at a time.

22 Claims, 13 Drawing Sheets

Figure 1A:
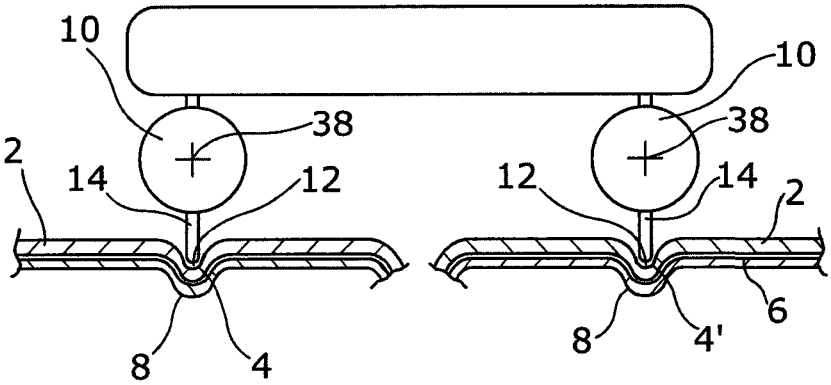

(51) Int. Cl.
*B05C 17/005* (2006.01)
*B05C 17/015* (2006.01)

(56) References Cited

U.S. PATENT DOCUMENTS

| | | | | |
|---|---|---|---|---|
| 5,211,755 | A * | 5/1993 | Hangley, II | A41D 1/10 118/306 |
| 6,363,634 | B1 * | 4/2002 | Hangley | D06F 71/29 38/1 B |
| 6,722,537 | B1 * | 4/2004 | Houlbrook | B05C 17/00516 222/611.1 |
| 2006/0283891 | A1 | 12/2006 | Kovac | |
| 2013/0168421 | A1 | 7/2013 | Galvin et al. | |

* cited by examiner

APPARATUS FOR THE APPLICATION OF MATERIAL TO A CREASE OF A GARMENT

CROSS-REFERENCE TO RELATED APPLICATIONS

This United States application is the National Phase of PCT Application No. PCT/GB2018/051482 filed 31 May 2018, which claims priority to British Patent Application No. 1708640.6 filed 31 May 2017, each of which is incorporated herein by reference.

The invention to which this application relates is apparatus of a form which can be used to apply a material to a garment and, in particular, to allow a ribbon or thin line of the material to be applied along a crease line formed in the garment. The material is typically a resin type material which is applied in a liquid form but which, when set, has a rigidity so as to help maintain the shape of the crease in the garment during use of the same.

The provision of a resin material along crease lines of a garment in order to maintain the crease and improve the appearance of the garment during use, is well known, and the applicant in their granted patents EP1405678 and EP1185379, disclose one form of apparatus. This, and other, form of apparatus are used extensively throughout the world and most typically used at the time of manufacturing the garment and/or following laundry of the garment.

It will be appreciated that each application of material from the cartridge in which the resin is held, takes time and, the cartridge, the apparatus in which the cartridge is located, the resin material which is dispensed and the operator time, all add to the cost of production of the garment and hence there is always pressure to be able to reduce the cost of the consumables, the apparatus and the operator time so as to reduce the impact on the overall cost of the garment whilst, and importantly, maintaining the benefits of prolonging the crease life by use of the apparatus and resin material as this is regarded as being a significant advantage in the sale of one form of garment with the resin material applied in comparison to another garment without the resin material applied to the crease lines.

An aim of the present invention is therefore to provide a means to allow the resin material to be applied in a more economic and time efficient manner whilst, at the same time, ensuring that the accuracy and beneficial effect of the application of the material is at least maintained and preferably improved.

In a first aspect of the invention, there is provided apparatus for the application of a fluid material along one or more crease lines formed in one or more garments, said apparatus including at least first and second cartridges in each of which a quantity of the said fluid material is held so as to be dispensed therefrom through an aperture and wherein at least during dispensing of the fluid material the cartridges are located on mounting means and spaced apart with their longitudinal axes substantially parallel.

In one embodiment the fluid material is dispensed during relative movement between the apparatus and the garment.

In one embodiment the relative movement between the cartridges and/or at least part of the mounting means is possible.

In one embodiment the relative movement between the cartridges and/or mounting means is within a predetermined range. In one embodiment the relative movement is linear inasmuch that the angle between the nozzle and the surface of the garment is substantially maintained. In one embodiment the angle is in the range of 80 to 100° and preferably substantially 90°.

In addition or alternatively the relative movement includes a degree of rotatable movement about an axis which is substantially parallel with the direction of movement of the cartridge and/or garment during the application of the fluid therefrom along the crease line.

Typically the garment is located on a support surface which is substantially flat save for the provision of a substantially V-shaped groove for the location of each garment crease line to which the fluid is to be applied at the same time.

In this embodiment typically the support surface will include a plurality of spaced, substantially parallel V-shaped grooves. Typically the spacing is substantially the same as the spacing between the cartridges.

Typically each of said cartridges is provided to be movable within a range of movement with respect to at least part of the mounting means and/or each other.

Typically each cartridge is independently movable.

Typically the cartridges are each linearly movable towards and away from each other within a predefined movement range. Typically during the movement the cartridges are maintained substantially parallel and with their respective nozzles substantially perpendicular to the surface of the support on which the garment is located.

In one embodiment, the cartridge is provided integrally with, or inserted into location with, the mounting means which then maintain the cartridges in a spaced parallel relationship.

In one embodiment, each of the cartridge nozzles is located with respect to a garment crease line so as to allow the simultaneous dispensation of material therefrom along the respective crease lines.

Typically the cartridge nozzles are located with respect to the crease lines such that the dispensed material is applied along the base of the respective crease lines rather than to one side of the crease line. This is achieved by allowing the movement of the cartridges with respect to the mounting means in order to take into account any deviation in the V-shaped grooves in the support surface whilst maintaining the outlet from the nozzle in position at the base of the crease.

In one embodiment, the mounting means includes resilient means which allow relative movement of the cartridges so as to maintain the nozzles in a position so as to dispense the material along the crease lines base Typically the resilient means are such as to allow the movement of the cartridge with respect to the mounting means so as to take into account any deviation in the crease line and/or between respective crease lines and thereby maintain the dispensation of the material along the base of the respective crease lines.

Typically the biasing means (most typically in the form of springs) are provided so as to allow the movement of the cartridge but when the movement force is removed, the resilience of the biasing means urge the cartridges back to a default position.

In one embodiment, the nozzles are provided as integral parts of the cartridge or alternatively, are inserted or attached to the cartridge. Typically location means are provided so as to maintain the nozzle in a non-rotatable position with respect to the cartridge at least one the cartridge and nozzle are in use. This acts to ensure that the nozzle is maintained in the required orientation with respect to the cartridge.

In one embodiment, the outlet from the nozzle is linear and the longitudinal axis of the said outlet is parallel with the crease to which the fluid material is applied.

In one embodiment the movement of the cartridge with respect to part of the mounting means is achieved by providing a sufficient space so as to allow movement of the cartridge within a range of movement defined by sidewalls of a slot of the mounting means in which at least the nozzle and/or fin of the cartridge is located.

In another embodiment the movement of the cartridge with respect to part of the mounting means is achieved by providing a first mounting means part which receives the cartridge in a substantially fixed position and said mounting means part is mounted with respect to a further part of the mounting means and is axially movable with respect thereto with respect to an axis that is offset to, and substantially parallel with the longitudinal axis of the cartridge.

In one embodiment the first part of the mounting means is provide with an arm which is received in a recess in the second part of the mounting means.

Typically the same connection is used for each of the cartridges provided on the mounting means.

In an alternative embodiment, biasing means are provided within the mounting means to allow the movement of the legs linearly within a predetermined range in at least one direction substantially perpendicular to the longitudinal axis of the cartridge and the biasing means act, once a movement force is removed or reduced from the cartridge, to return the cartridge to a default position.

Thus, in whichever embodiment the cartridges and in particular the nozzle can move within a predetermined range of movement to take into account deviation in the crease line or in the surface underlying the crease and at the same time, once the deviation is passed or other movement force is removed, the nozzles will return to respective default locations with respect to the mounting means and the crease lines.

In a further aspect of the invention, there is provided apparatus for the application of a fluid material along crease lines of one or more garments, said apparatus including mounting means for locating at least first and second cartridges in which quantities of the fluid material is held and dispensed therefrom via respective nozzles during relative movement between the apparatus and the garment and wherein the said cartridges are provided so as to simultaneously dispense the said fluid material along first and second crease lines.

In one embodiment the first and second crease lines are spaced apart on the garment by a distance which is substantially the same as the distance of the spacing between the respective longitudinal axes of the first and second cartridges.

In one embodiment the mounting means include a first portion locating the cartridges at or towards one end and a second portion locating the cartridges at or towards the opposing end.

In one embodiment the first and/or second portions of the mounting means include springs mounted therein to allow movement of the cartridges with respect to each other, whilst biasing the same to a default position in which the same are substantially parallel.

In a further aspect of the invention there is provided apparatus for the dispensing of a fluid along one or more crease lines in ne one more garments, said apparatus including two or more cartridges, each cartridge including a quantity of the aid fluid therein and said fluid is dispensed from the cartridges via an aperture by the provision of a pressurised fluid source onto a nozzle located to be moved by the pressurised fluid along the interior of the cartridge so as to move the fluid towards the said aperture to be dispensed, a supply of said pressurised fluid is attached to each cartridge and control means are provided to allow the user selection of the supply of said pressurised fluid to the cartridges, a support base having spaced apart grooves for the rescript there along of the crease lines to which the fluid is to be dispensed and wherein mounting means are provided to allow the two or more cartridges to be located in a spaced apart relationship, with a spacing substantially equal to the spacing between said spaced apart grooves and relative movement between the mounting means with the cartridges located therein and the support base a lows the fluid being dispensed from the said cartridges to be dispensed along the said crease lines.

In one embodiment the control means for the pressurised fluid is provided with a user actuation means which is located on or adjacent to the mounting means so as to be operable by the user when gripping the mounting means.

Figure 1B:
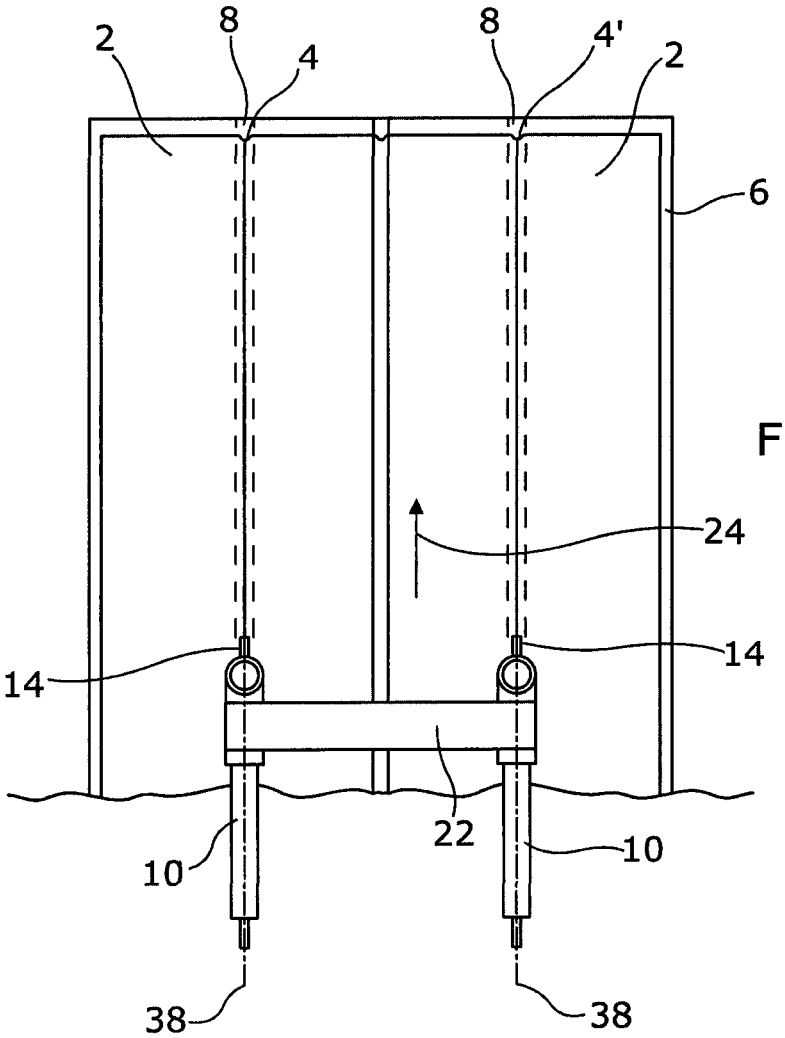
Figure 2:
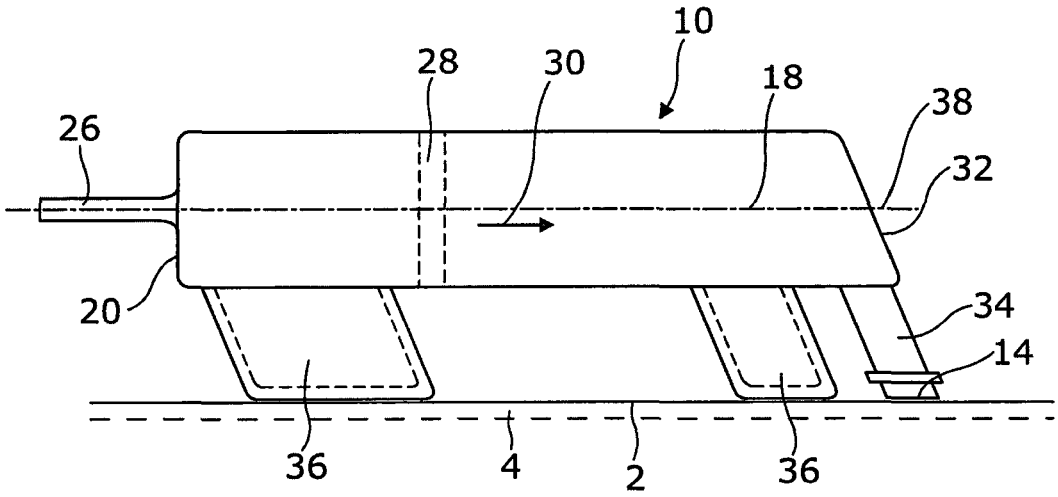
Figure 3A:
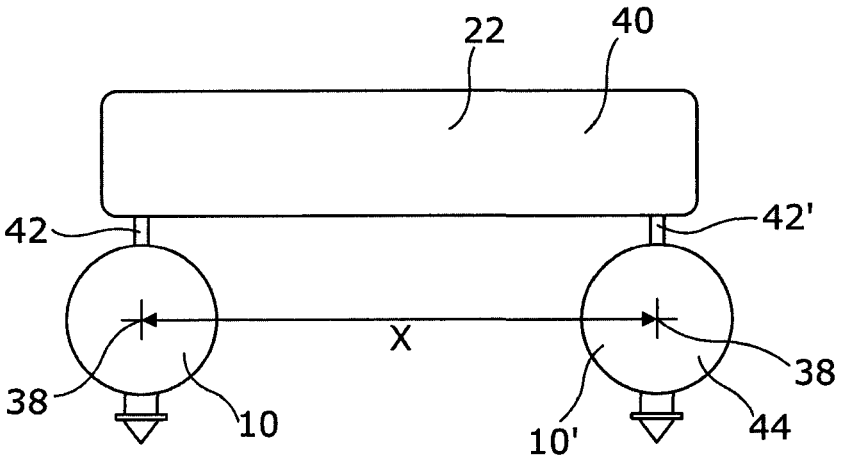
Figure 3B:
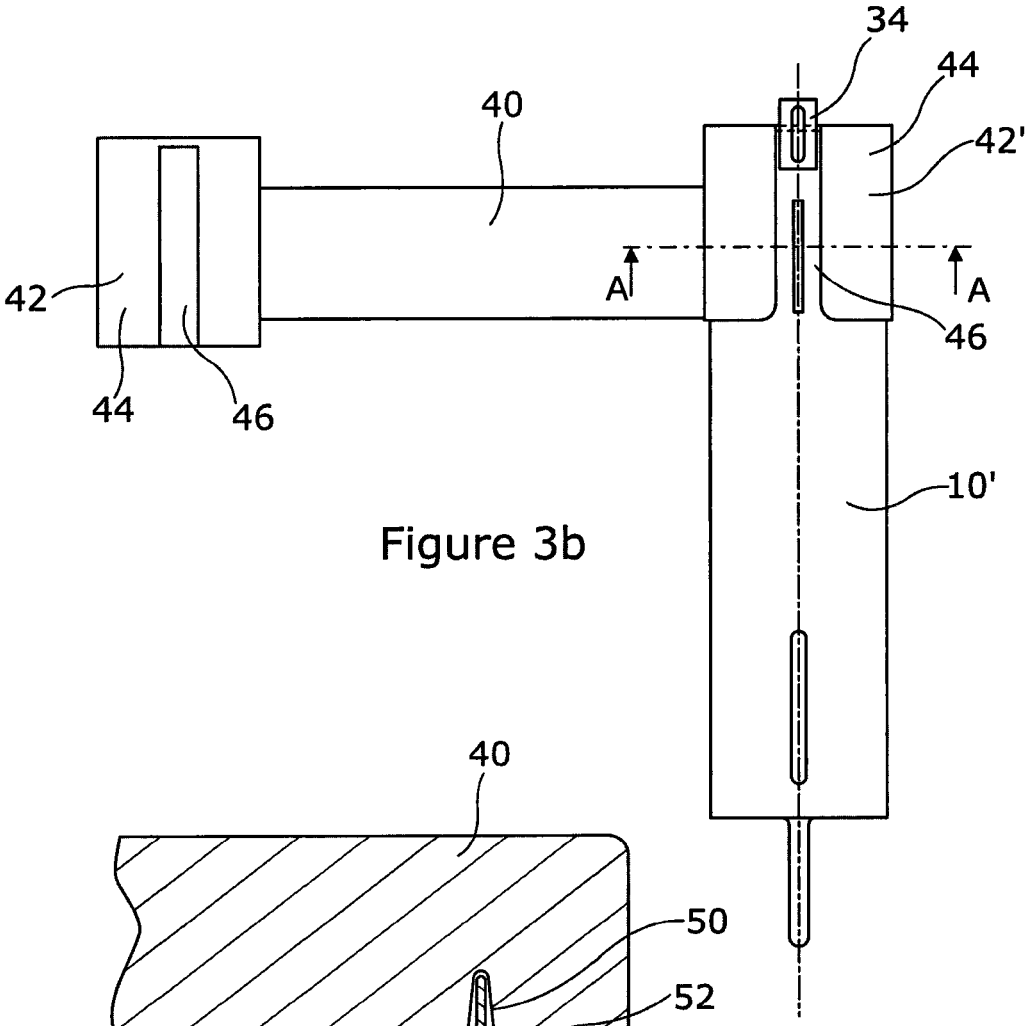
Figure 3C:
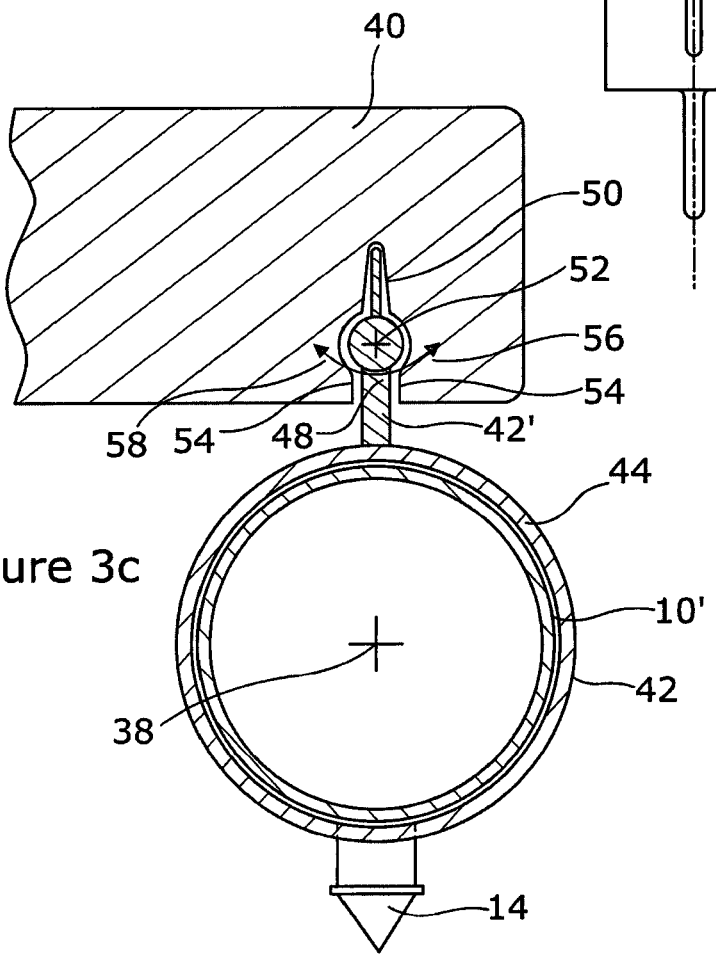

Specific embodiments of the invention are now described in accordance with the accompanying drawings; wherein FIGS. 1*a* and *b* illustrate the manner in which lines of fluid material are applied along garment crease lines in accordance with one embodiment of the invention;

FIG. 2 illustrates a cartridge of a type which can be used in the current invention;

FIGS. 3*a* to *c* illustrate views of one embodiment of mounting means for use with the cartridges as shown in FIGS. 1*a-b;*

Figure 4A:
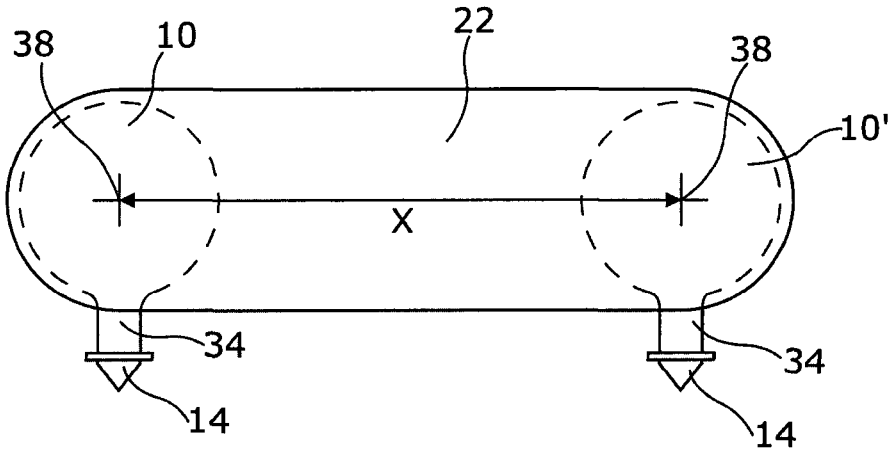
Figure 4B:
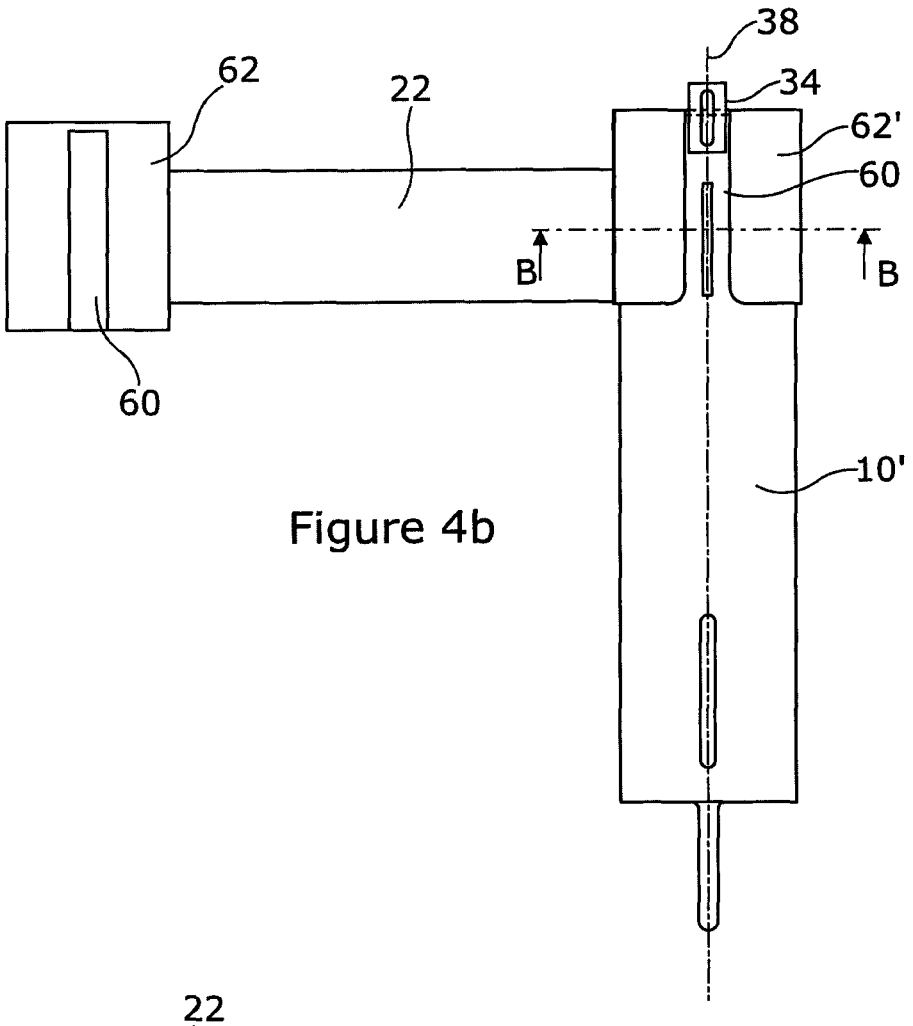
Figure 4C:
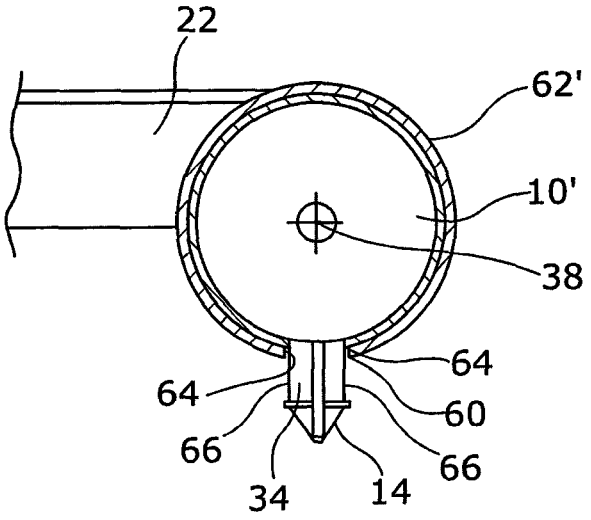

FIGS. 4*a* to *c* illustrate views of another embodiment of mounting means for use with the cartridges as shown in FIGS. 1*a-b;*

Figure 5A:
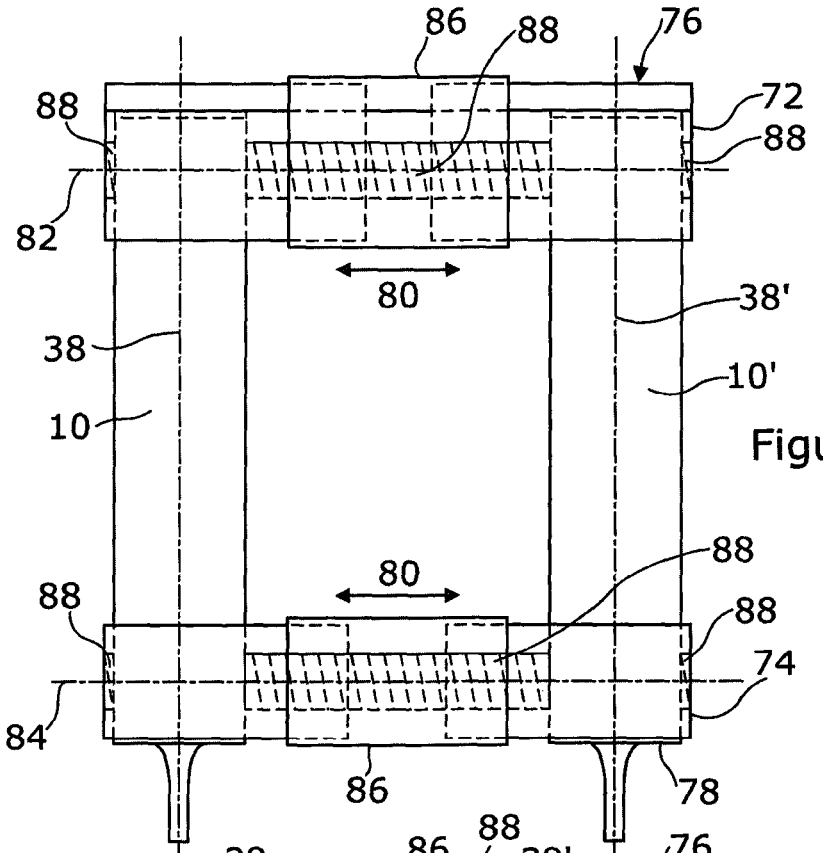
Figure 5B:
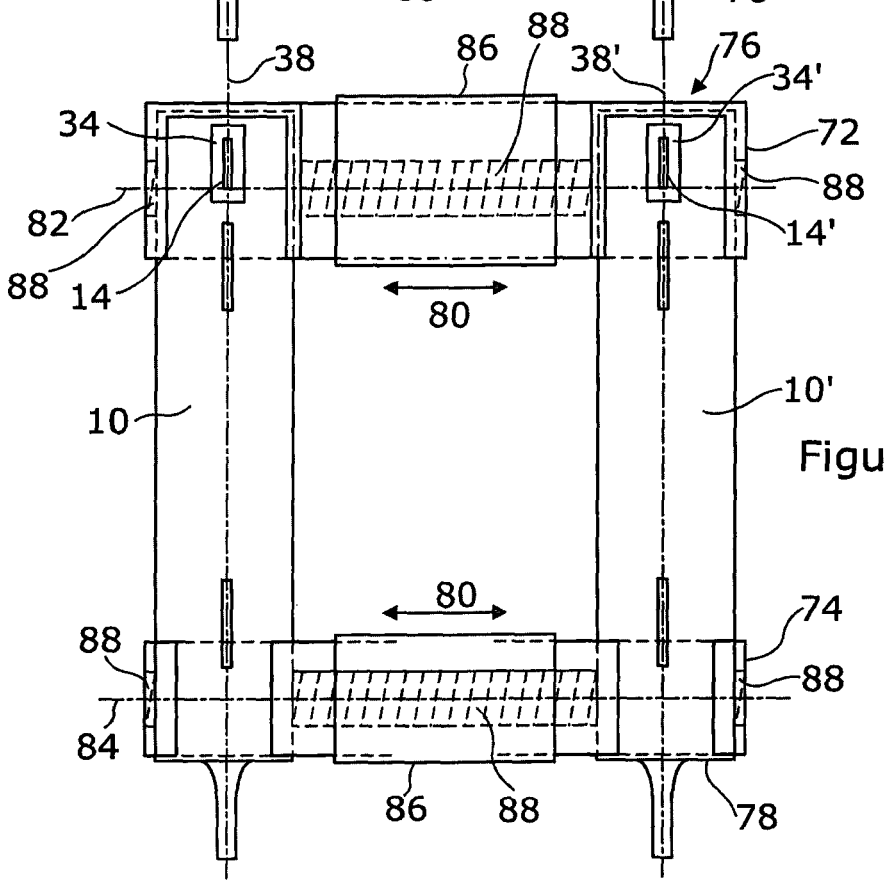
Figure 6A:
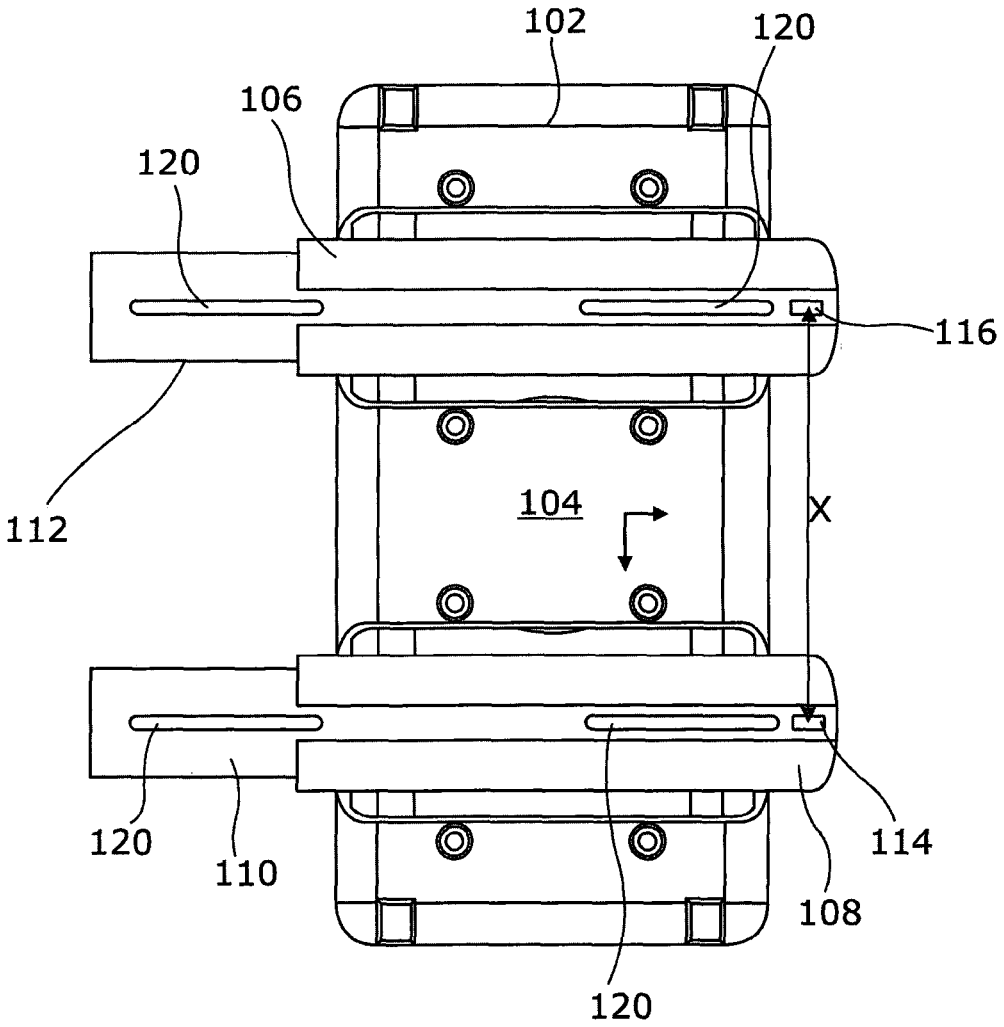
Figure 6B:
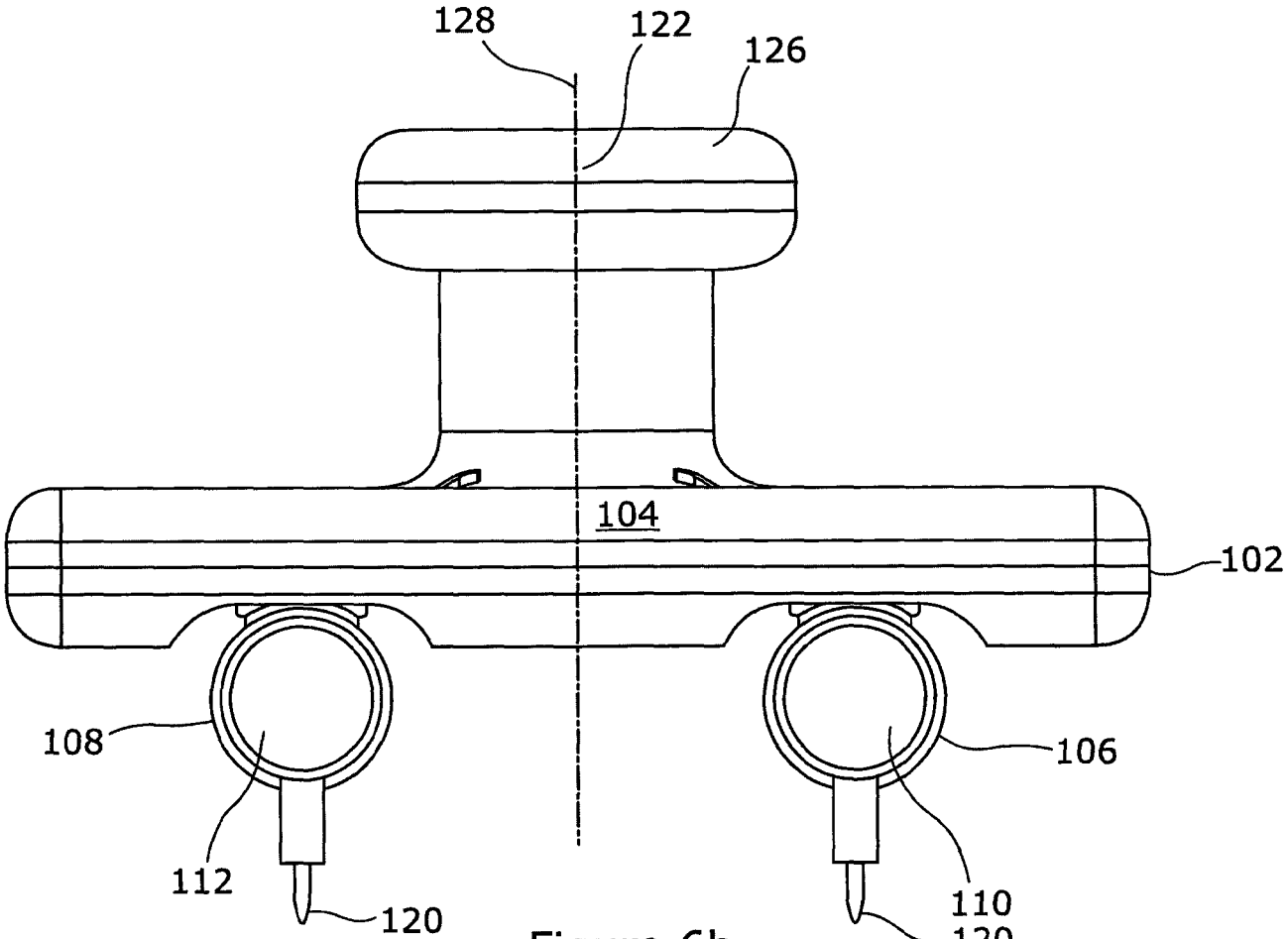
Figure 6C:
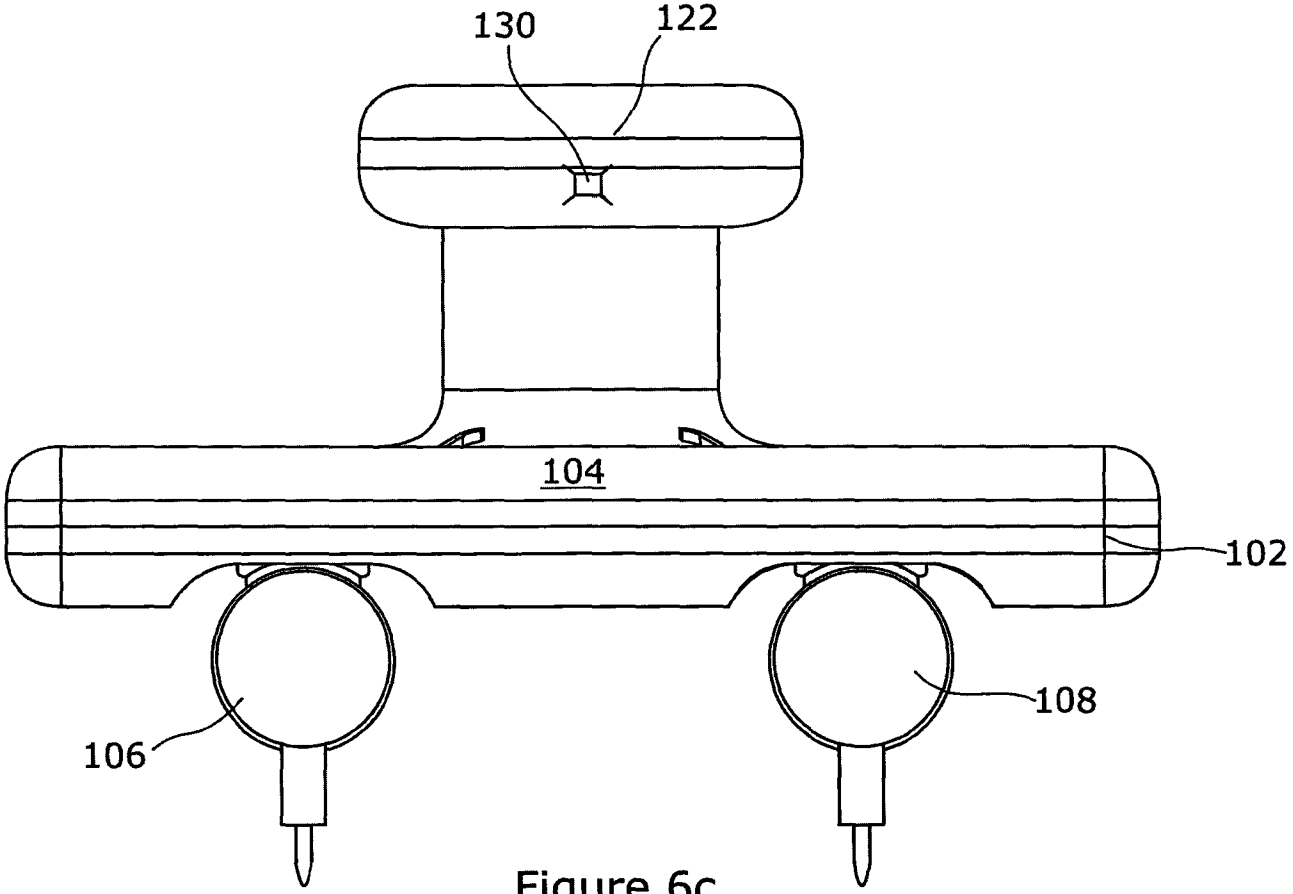
Figure 6D:
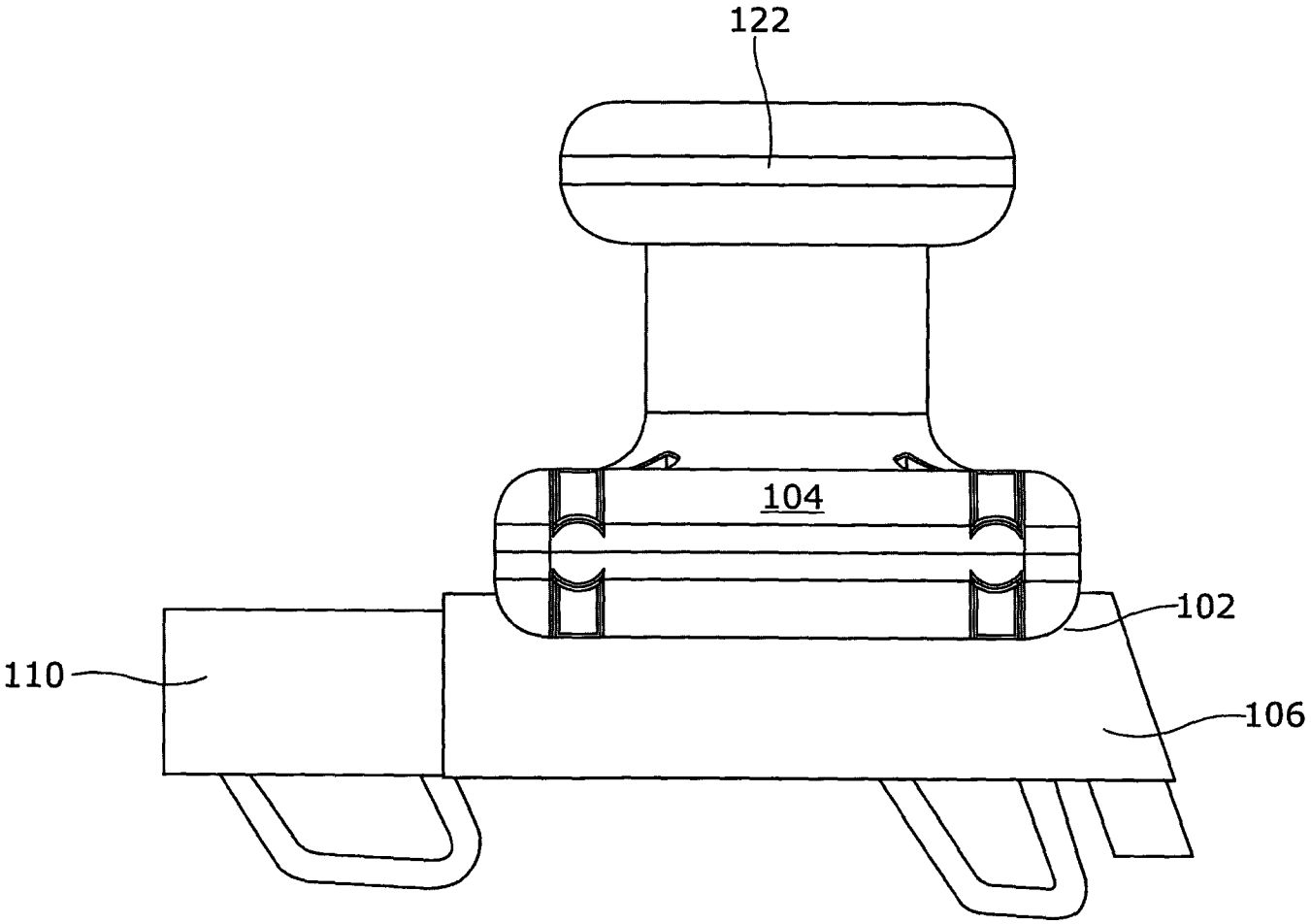
Figure 6E:
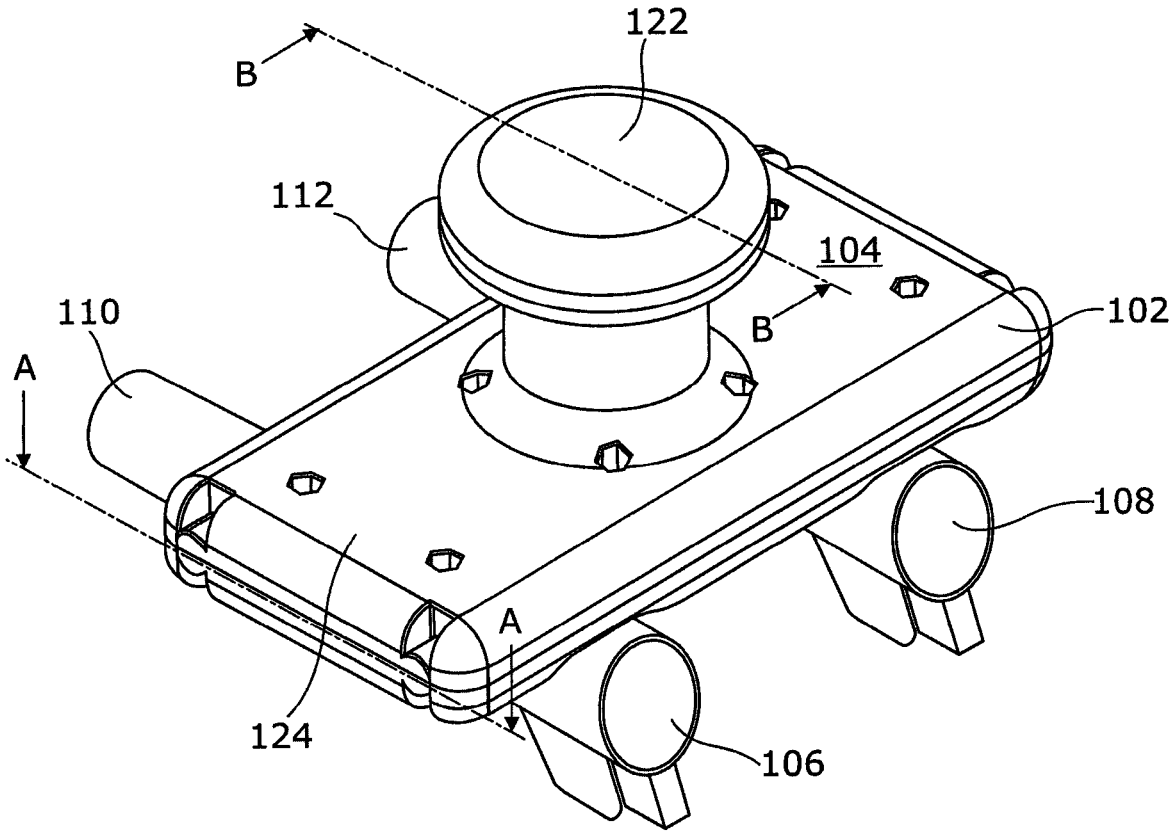
Figure 6F:
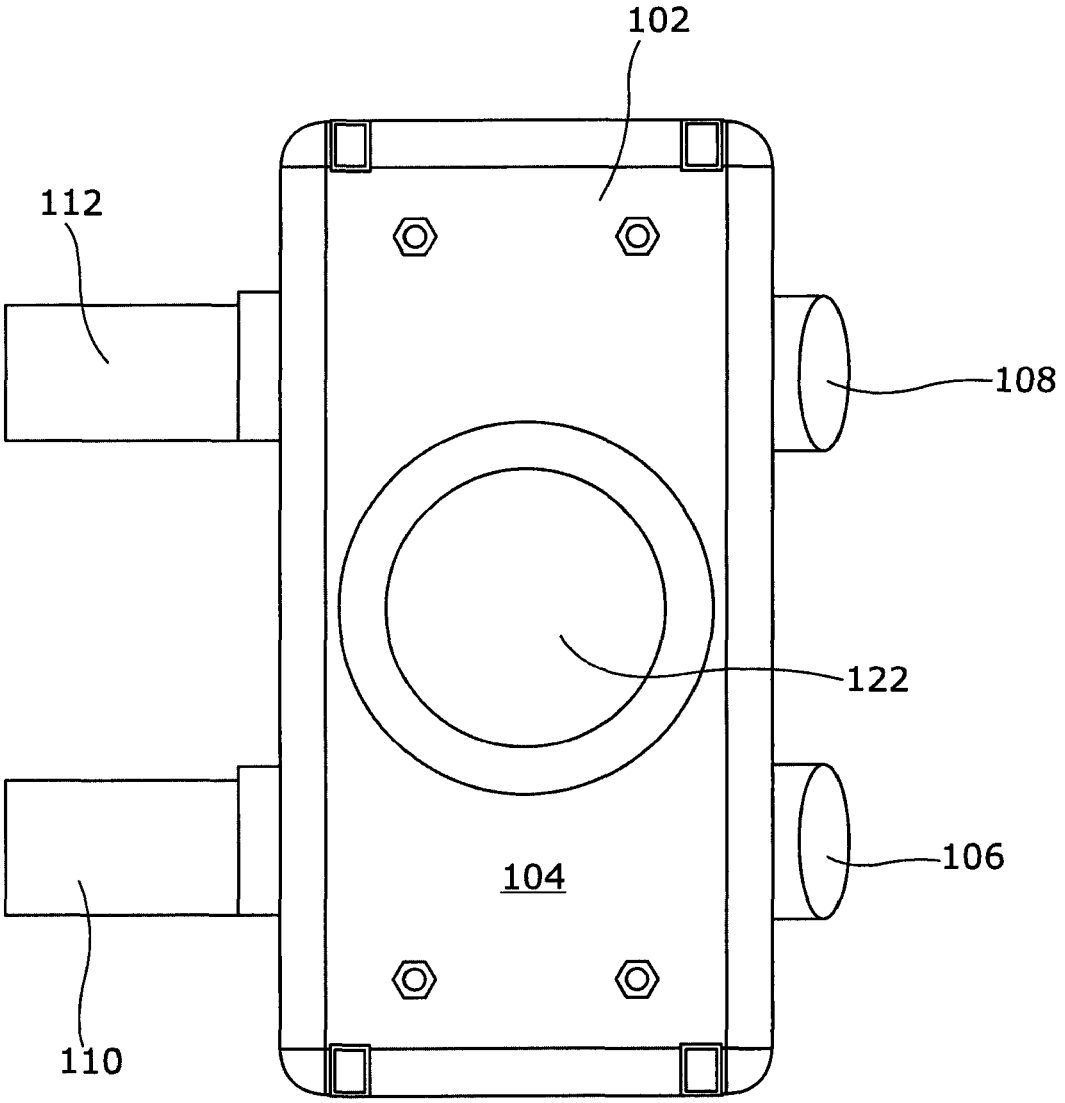

FIGS. 5*a* and *b* illustrate plan views from the top and bottom of a third embodiment of the mounting means for use with the cartridges as shown in FIGS. 1*a-b;*

Figure 7:
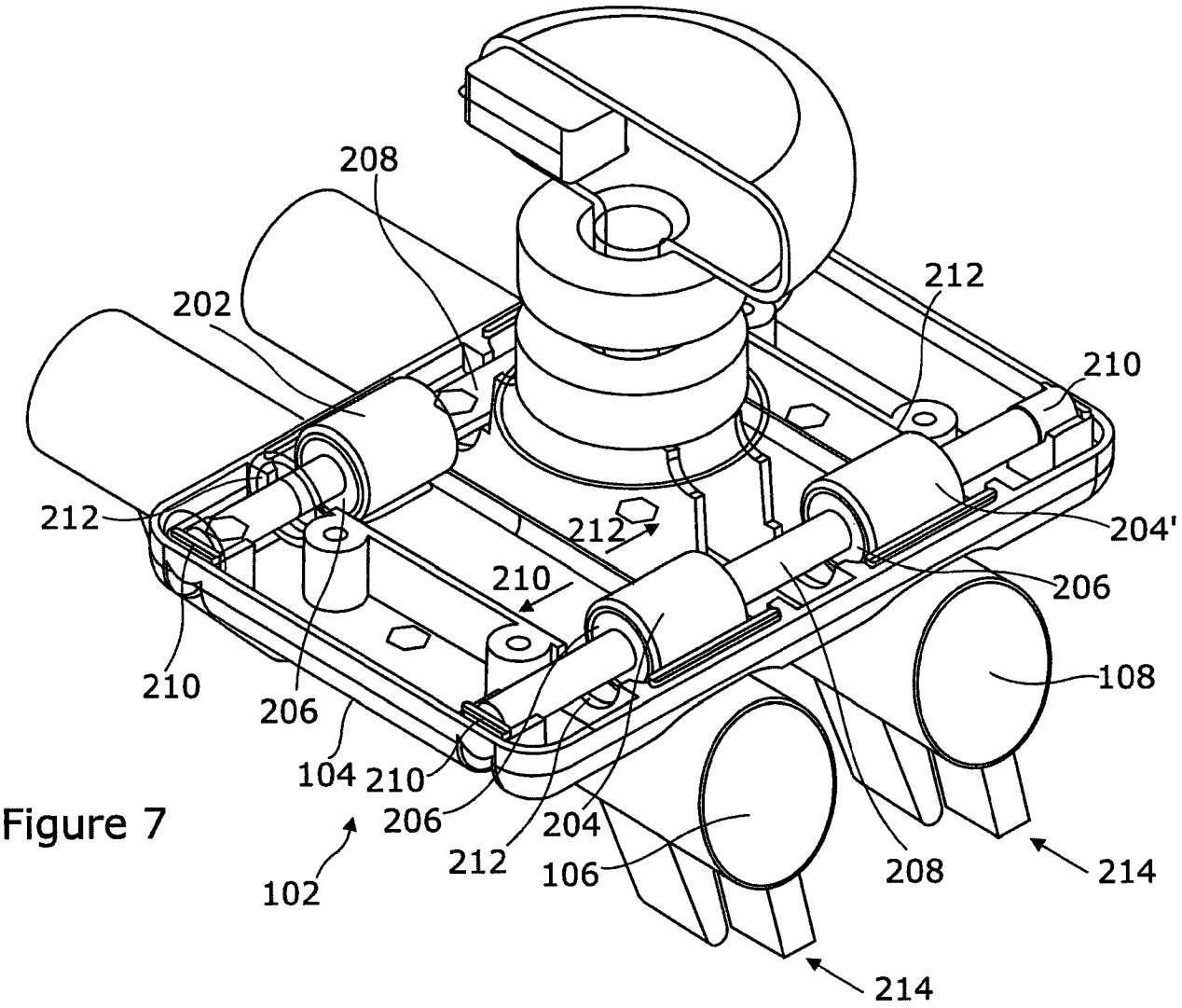

FIGS. 6*a-f* illustrate a further embodiment of the mounting means in accordance with the invention; and FIG. 7 illustrates a cross sectional elevation of the embodiment of FIGS. 6*a-f* along lines A-A and B-B.

Referring firstly to FIGs. 1 and *b*, there is illustrated a garment 2 such as a pair of trousers, which have crease lines 4 formed therein. The crease lines 4 are shown in position on a support surface 6 and it is shown that the crease lines 4 are located in respective grooves 8 which may be V or gull wing shaped in sections 8 which run substantially parallel along the support surface. With the crease lines 4 in position, then in accordance with the invention, respective cartridges 10 in which the fluid resin material is held can be used to deposit, from an aperture in their respective nozzles 14, a ribbon 12 of the fluid material therefrom, along the length of the crease line, with the aim being to ensure that the ribbon of resin which is dispensed is dispensed into the base of each crease line as there is relative movement between the cartridges and the garments. In this embodiment the cartridges 10 and mounting means 22 therefore are moved as indicated by arrow 24 such that the nozzles 14 move along the crease lines 4 Once applied, the resin then cures and serves to maintain the crease line in the garment for a longer period of time than if the resin was not present and thereby maintaining the appearance of the garment.

FIG. 2 illustrates a cartridge 10 of a type which is suitable for use in accordance with the invention and the cartridge comprises a body 18 which has a cavity therein and in which the fluid resin is held. At one end 20 of the cartridge there is provided a connection for a pressurised gas connection which causes movement of a piston 28 in the cavity in the direction of arrow 30 so as to cause the movement of the resin towards the opposing end 32 at which there is provided a tongue 34 with nozzle 14 secured therein. A bore passes through the tongue and hence into a bore in the nozzle which in turn leads to an elongate aperture in the nozzle which allows the ribbon of resin to be applied from the cartridge 10. The cartridge, or mounting means therefore, can also include guide means in the form of fins 36 which are aligned with the outlet of the nozzle along the longitudinal axis 38 of the cartridge so that these are moved along the crease line and groove in advance of the nozzle with respect to the direction of movement so as to further assist in ensuring that the ribbon of the material is applied into the base of the crease line 4 during the relative movement between the garment and the cartridge to apply the resin material.

The cartridges 10 are typically provided as a disposable item such that once the resin therein has been used, the cartridge can be disposed or alternatively, the cartridge could be provided to be refilled. In either case, it is desired that the cartridge can be removed from the apparatus for disposal and replacement, or refilling.

In accordance with the invention, the apparatus further includes a mounting means 22 which, in this embodiment includes receiving locations for two cartridges 10 and allows the first and second cartridges to be located with their respective longitudinal axes 38 substantially parallel to each other and spaced apart by a predetermined distance X The distance of separation will typically be that of a space in between the two grooves 8 in the work surface 6 so as to allow the resin material to be applied from the said first and second cartridges 10 simultaneously along the two crease lines 4, 4' each respectively located in a groove 8. It will therefore be appreciated that this will allow the application of the resin material from two cartridges and hence at a much faster rate than by using one cartridge, although it should be appreciated that the mounting arrangement which is now described for the cartridges can be effective and provide advantage in the mounting of only one cartridge. In order to allow the use of the two cartridges 10, it is important that the same are held in a parallel relationship and that this parallel relationship can be ensured each time the respective cartridges are placed into the mounting means.

In addition, it is important that the cartridges 10 are movable within a predetermined range of movement in order to allow variations in the location of the creases 4 and/or the grooves 8 to be taken into account and ensure that the resin material line follows the base of the crease 4 as, if this is not achieved then the resin material would be applied to one side of the crease which would not be as effective in extending the lifetime of the crease. In accordance with the invention, this is achieved by providing a degree of cartridge movement in the mounting means 22 to allow relative movement between the cartridges and/or between the cartridge and the mounting means and thereby allow relative movement of the cartridges whilst ensuring that the same are encouraged to move back to the predetermined spacing X.

In FIGS. 3*a-c* one embodiment of the mounting means 22 is shown and it can be seen that the mounting means comprise a first part 40, a further part 42 for connection with cartridge 10 and a further part 42' for connection with cartridge 10'. In FIG. 3*b*, cartridge 10 is removed for ease of illustration and in FIG. 4*c* part of the first part 40 of the mounting means is shown in cross section along line A-A.

The parts 42, 42' are provided with a receiving housing 44 into which the end 32 of the cartridge is located and the tongue 34 is inserted along a slot 46 in the housing. The part 42,42' also includes a shaped arm 48 which is received in a shaped recess 50 in the part 40 of the mounting means 22. The arm 48 and recess are shaped so as to allow relative movement about a pivot axis 52 which is typically in line with the axis 38 of the cartridge and the relative movement is rotational movement as indicated by arrows 56, 58 with the range of movement defined by the contact between the arm 48 and the sidewalls 54 of the recess.

An alternative embodiment is illustrated in FIGS. 4*a-c* wherein there is shown a mounting means 22 which includes therein receiving housings 62, 62' which are provided to receive the end 32 of the cartridges 10. 10' therein. In FIG. 4*b*, cartridge 10 is removed for ease of illustration and in FIG. 4*c* part of the first part 40 of the mounting means is shown in cross section along line B-B. The tongue 34 of each cartridge is received in a slot 60, 60' and it is the degree of movement between the walls 64 of the slot 60 and the walls 66 of the tongue 34 which define the possible range of movement in the directions of arrows 68, 70 about the axes 38 of the cartridges 10, 10'.

A third embodiment is illustrated in FIGS. 5*a* and *b*. In this case the mounting means 22 is shown to comprise two portions 72, 74, although it should be appreciated that it would still be possible to use only one portion as in the other embodiments.

The first portion 72 is mounted at the tongue 34, 34' end 76, of the cartridges 10, 10' and the second portion 74 is mounted at the inlet end 78 of the cartridges 10, 10' so as to retain the same in a substantially parallel relationship and with the nozzles 14 substantially perpendicular to the support surface and garment thereon. In this relationship it can be ensured that the outlets from the respective cartridge nozzles lie in and are moved along the base of the respective crease lines so as to move accurately and effectively apply the fluid into the base of the crease as the cartridges are moved along the respective crease lines of the garment.

On occasion, the grooves 8 in the support surface in which the crease lines lie may deviate from straight and parallel due to inconsistencies when manufacturing the same and/or due to wear and/or due to warping of the support surface. In this embodiment, in order to allow the nozzles 14, 14' of the cartridges 10,10' to follow the base of the groove 8 and hence the crease line lying therein, the cartridges 10. 10' are movable linearly with respect to the mounting means body within a predefined range of movement. The movement is linear as indicated by the arrows 80 and are along axes 82,84 which are substantially perpendicular to the longitudinal axes 38, 38' of the cartridges 10, 10'. The movement is achieved and controlled in this embodiment by providing telescopic sections 86 in each of the portions 72, 74 between the cartridges 10, 10'.

In order to ensure that when the cause for movement of the cartridges has been removed the cartridges return to the default position, the portions 72, 74 include springs 88 which can be overcome by the movement force exerted on the nozzles, and in turn the cartridge, by the deviation of the grooves 8 as the guide fins 36 follow the same as the cartridges are moved along the respective crease lines and grooves to apply the fluid. However the springs are sufficiently strong such that when the movement force is removed the springs exert a force so as to move the cartridges 10, 10' back into the default positions with the required spacing.

Referring now to FIGS. 6*a-f* there is illustrated a further embodiment of mounting means 102 in accordance with one embodiment of the invention.

Once again, the mounting means 102 include a body 104 and, located with the body, are first holding means 106 and second holding means 108. Each of the holding means is provided to receive a cartridge 110, 112 therein and to thereby position the respective cartridges with regard to the body.

Typically, the spacing X between the cartridges and in particular, the nozzles of with dispensing apertures 114 116 of the cartridges, when located in the holding means, is substantially the same as the spacing between the respective garment crease lines when located in the grooves 8 in the work surface and thereby allow the resin to be simultaneously dispensed from the respective cartridges through the aperture in the nozzles and along the base of the crease lines. In one embodiment the spacing X is 55 mm. In one embodiment the spacing between the cartridges is adjustable to allow the same to be altered to react to being used with support surfaces which have grooves with a different spacing between the same. Typically once the adjustment has been made the spacing is locked so as to prevent further alteration during the use of the mounting means with the particular work surface.

The guidance of the movement of the mounting means and hence cartridges 110, 112 along the crease lines, is again achieved by the provision of guide fins 120 on each of the cartridges which are located such that when the cartridges are moved with the mounting means, the guide fins are in advance of the dispensing nozzle and can therefore be moved along the crease and hence grooves in advance of the resin which is being dispensed from the cartridge nozzle.

Thus, in accordance with the invention, the mounting means as shown, allow the simultaneous dispensation of resin from the two cartridges 110, 112 in a controlled manner.

The body 104 also includes a handle portion 122 which is located on a surface 124 of the body opposing that to which the holding means are located. The handle is provided with a head portion 126 which is provided to be gripped by the user in order to move the body, mounting means and cartridges as an integral unit. The handle can be of any desired form but it is believed that the shape as shown is particularly advantageous in being comfortable to be gripped whilst at the same time, ensuring that a secure grip can be achieved to move the mounting means and cartridges in a controlled manner. The head portion 126, in this embodiment, is rotatable about an axis 128 so as to aid in the continued straight line movement of the body by the user as the distance of the body and angular orientation of the same from the user changes and therefore maintains a straight line of movement along the groove and avoids the possibility of the movement of the mounting means being along a bend as the user. The rotation of the head portion 126 allows the user to continue to grip it in the same way and move the mounting means in a straight line whilst the relative position of their hand with respect to the body 104 changes.

In one embodiment, the body and/or handle may also include a control switch 130 for user actuation to allow the switching on and off of the pressurised fluid source which is directed to both of the cartridges 106, 108 in order to move the pistons which are located within the respective cartridges towards the dispensing nozzles and hence move the resin which is to be dispensed towards the nozzle under pressure to ensure that the resin is emitted from the nozzle aperture in a continuous manner. In the embodiment shown the switch 130 is located on the head portion to be selectively moved. In another embodiment the head portion may be the switch and can be activated by selectively moving the same to different positions along the axis 128 to activate a microswitch located in the body of the mounting means.

Typically the pressurised are source includes a regulator to allow equal gas, typically pressurised air flow into the respective cartridges. This and/or manual adjustment allows the air supply to be adapted to suit different potential flow rates of the fluid material in particular cartridges and/or to take into account variation in environmental conditions which may affect the flow rate of the fluid.

Typically, the holding means and/or handle are located with the body in a manner to allow limited movement of the same with respect to the body 104 so as to take into account any variation in movement of the cartridge as it is moved along the crease line whilst, at the same time, ensuring that the resin is still applied into the crease rather than to a side of the same.

FIG. 7 illustrates the mounting means of FIGS. 6*a-f* with the top part of the body 104 removed for ease of illustration and it is shown the manner in which, for each of the cartridges 106, 108, there are provided first and second supports 202,204 and 202',204' respectively. Each of the supports has a channel in which there is provided a bearing 206. In turn, the bearing has an aperture which receives therein a shaft 208 and the shaft extends along the width of the body 104. Each shaft 208 is received in end supports 210 at opposing ends of the same which therefore retain the shaft in position with respect to the body. Spaced inwardly of the same, there are provided stops 212 which are sized so as to allow the shaft to pass there through but to prevent the carrier 204 of the cartridge from passing there through. This therefore means that the range of movement in the direction of arrows 210 212, is restricted by the stops whilst, at the time, the gap between the stops 212 and the end face 204 of the carrier, allow a limited scope of movement and hence a limited scope of limited movement of the cartridge attached to the carrier 204. Thus, in accordance with the invention it will be seen that the relative spacing between the cartridges is adjustable as cartridges are moved in the direction 214 along the respective crease lines in the garment a and grooves 8 in the work surface. Once again springs, not shown, can be provided to act, in this case, between a stop 212 and the end surface of the adjacent carrier 204,206, 204',206', in order to bias the respective cartridge position to a default position.

The need to provide the possibility of movement between respective cartridges and/or a cartridge with respect to the body, is required in order to allow the nozzle through which the fluid material is dispensed from each cartridge, to remain in a plane which is substantially perpendicular to the longitudinal axis of the body of the mounting means. The mounting means body, in turn, is provided to be substantially parallel with the work surface in which the grooves 8 are provided and upon which the garment to which the fluid material is to be applied, is located. This, in turn, means that the fluid material is dispensed into the base of the crease lines of the garment and along the same to thereby ensure that the fluid material is located in the required position so as to act to maintain the crease in the garment. If the fluid material is not dispensed into the crease line but, instead, is applied onto the garment surface adjacent to the crease line then the fluid material does not act on the crease and therefore does not provide the required permanence of crease characteristic. Thus, if the linear movement between the cartridges and/or the cartridges and the body was not possible the line of application of the fluid can diverge from the line along which the crease follows the groove in the surface.

It will therefore be appreciated that in accordance with the invention, there is provided apparatus which allows the application of resin material along crease lines in substantially less time than the conventional systems which only use one cartridge at a time. In addition, the quality of application of the resin is maintained and it is ensured that the application of the resin is along the base of the crease as required.

The invention claimed is:

1. Apparatus for application of a fluid material along first and second, substantially parallel, crease lines of one or more garments, said apparatus including first and second cartridges in each of which a quantity of said fluid material is held so as to be dispensed therefrom through an aperture provided in said first cartridge and an aperture in said second cartridge and at least during dispensing of the fluid material the cartridges are located on mounting means which includes a body and a first receiving location for the first cartridge and a second receiving location for the second cartridge and said cartridges are spaced apart with their longitudinal axes substantially parallel, so as to dispense the fluid material from the first and second cartridges as ribbons of the fluid material along the respective first and second crease lines, said first and second cartridges and/or mounting means including guides to be moved along and in contact with the first and second crease lines during the application of the fluid material so as to guide the movement of the mounting means and first and second cartridges and wherein the mounting means includes a handle portion to be gripped by a user to move the mounting means and both of said first and second cartridges as a single unit with respect to said one or more garments so as to simultaneously dispense said fluid material from said apertures of the first and second cartridges along said respective first and second crease lines.

2. Apparatus according to claim 1 wherein relative movement between the cartridges and/or at least part of the mounting means is possible.

3. Apparatus according to claim 2 wherein said relative movement is within a predetermined range.

4. Apparatus according to claim 1 wherein an angle between a nib of a nozzle of the first and second cartridges and a surface of the one or more garment is substantially maintained.

5. Apparatus according to claim 4 wherein said angle is in a range of 80 to 100°.

6. Apparatus according to claim 1 wherein the one or more garments is located on a support surface which includes first and second grooves with angularly offset side walls, each groove provided for location of one of said first and second, substantially parallel crease lines along at least part of which the fluid material is to be applied.

7. Apparatus according to claim 6 wherein the first and second grooves are spaced apart by a distance which is substantially the same as a spacing between the apertures of the first and second cartridges when located in the mounting means.

8. Apparatus according to claim 7 wherein the spacing between said apertures is user adjustable to match a spacing between the first and second grooves with respect to which mounting means is to be used.

9. Apparatus according to claim 1 wherein each cartridge is independently movable within a predetermined range of movement.

10. Apparatus according to claim 1 wherein during movement the cartridges are maintained substantially parallel and with nozzles provided thereon substantially perpendicular to a surface of a support on which the garment is located.

11. Apparatus according to claim 1 wherein the first and second cartridges are provided integrally with, or inserted into location with, the respective first and second receiving locations which maintain the cartridges in a spaced apart parallel relationship.

12. Apparatus according to claim 1 wherein each cartridge includes a nozzle located with respect to said first and second crease lines when the cartridges are located in the mounting means so as to allow simultaneous dispensation of the fluid material therefrom along the respective first and second crease lines.

13. Apparatus according to claim 1 wherein the mounting means allow relative movement of the first and second cartridges with respect to each other and/or the mounting means.

14. Apparatus according to claim 13 wherein the relative movement is such as to take into account any deviation in the first and second crease lines and/or grooves of a support surface in which the first and second crease lines are located and thereby maintain the dispensation of the material along a base of the first and second crease lines.

15. Apparatus according to claim 13 wherein springs bias the cartridges to be located at respective default positions with respect to the body of the mounting means.

16. Apparatus according to claim 1 wherein the aperture of the first cartridge is provided in a nozzle of the first cartridge and the aperture of the second cartridge is provided in a nozzle of the second cartridge said apertures are linear, and a longitudinal axis of said aperture is parallel with the first and second crease lines to which the fluid material is applied, when the first and second cartridge are located in the mounting means for the application of the fluid material.

17. Apparatus according to claim 1 wherein the handle includes a head portion which is rotatable with respect to a remainder of the mounting means.

18. Apparatus according to claim 1 wherein there is provided a switch on the mounting means to allow a user control of a pressured fluid source to said cartridges.

19. Apparatus for application of a fluid material along at least first and second crease lines of one or more garments, said apparatus including mounting means including a body and a first receiving location for a first cartridge and a second receiving location for a second cartridge, quantities of the fluid material held in and dispensed from said first and second cartridges via respective nozzles during relative movement between the apparatus and the one or more garments and wherein said first and second cartridges and/or mounting means include guides to be moved along and in contact with the first and second crease lines during the application of the fluid material so as to guide the movement of the mounting means and first and second cartridges and wherein the mounting means includes a handle portion to be gripped by a user to move the mounting means and both of said first and second cartridges located thereon as a single unit with respect to said one or more garments so as to simultaneously dispense ribbons of said fluid material from said respective nozzles of the first and second cartridges along said respective first and second crease lines.

20. Apparatus according to claim 19 wherein said first and second crease lines are spaced apart on the one or more garments by a distance which is substantially the same as a distance of a spacing between the respective longitudinal axes of the first and second cartridges.

21. Apparatus according to claim 19 wherein the mounting means include a first portion locating with the cartridges at or towards one end of the cartridges.

22. Apparatus according to claim 21 wherein first and second holder carriers are provided which engage the first and second cartridges to the mounting means and springs mounted in the body of the mounting means allow movement of the first cartridge with respect to the second cartridge, whilst biasing the same to a default position in which the cartridges are substantially parallel.

* * * * *